US005610504A

United States Patent [19]

Tsugita

[11] Patent Number: 5,610,504

[45] Date of Patent: Mar. 11, 1997

[54] AUTOMATIC REGULATING CIRCUIT FOR REGULATING TARGET SIGNAL THROUGH BINARY SEARCH

[75] Inventor: Masami Tsugita, Tokyo, Japan

[73] Assignee: NEC Corporation, Tokyo, Japan

[21] Appl. No.: 526,209

[22] Filed: Sep. 11, 1995

[30] Foreign Application Priority Data

Sep. 14, 1994 [JP] Japan ..... 6-219336

[51] Int. Cl.[6] ..... G05F 1/445

[52] U.S. Cl. ..... 323/283; 323/281

[58] Field of Search ..... 323/274, 280, 323/281, 282, 283, 284

[56] References Cited

U.S. PATENT DOCUMENTS 3,818,306 6/1974 Marini ..... 323/283 X
4,438,498 3/1984 Sekel et al. ..... 323/283 X
5,432,693 7/1995 Anderson ..... 323/283 X

OTHER PUBLICATIONS

T. Tamura et al.; "A Single-Chip Video-Processing IC Made by an Improved BI-CMOS Process"; 1992 IEEE WPN 15.7, pp. 264–265.

*Primary Examiner*—Peter S. Wong
*Assistant Examiner*—Y. J. Han
*Attorney, Agent, or Firm*—Whitham, Curtis, Whitham & McGinn

[57] ABSTRACT

An automatic regulating circuit gradually regulates an output voltage to a reference value in synchronism with a clock signal, and has a binary search controller changing the value of a control signal across a final value corresponding to said reference value until a convergence at the final value; the control signal is supplied to a level shifting system so as to converge the output voltage at the reference value, and the automatic regulating circuit quickly completes the voltage regulation.

8 Claims, 9 Drawing Sheets

AUTOMATIC REGULATING CIRCUIT FOR REGULATING TARGET SIGNAL THROUGH BINARY SEARCH

FIELD OF THE INVENTION

This invention relates to an automatic regulating circuit improved in response characteristics and, more particularly, to an automatic regulating circuit quickly regulating a target signal through a binary search.

DESCRIPTION OF THE RELATED ART

A typical example of the automatic regulating circuit is disclosed by T. Tamura et. al. in "A SINGLE-CHIP VIDEOPROCESSING IC MADE BY AN IMPROVED BI-CMOS PROCESS", 1992 IEEE WPN 15.7, pages 264 and 265, and the prior art automatic regulating circuit is illustrated in FIG. 1 of the drawings.

A comparator 1, an up-and-down counter 2, a digital-to-analog converter 3 and a level-shifter 4 form in combination the prior art automatic regulating circuit, and the level shifter 4 is incorporated in an output circuit for driving a cathode ray tube 7 in cooperation with a bipolar transistor 8.

A reference voltage source 9 supplies a reference voltage REF to the comparator 1, and the comparator compares the collector voltage Vc with the reference voltage REF. The comparator 1 increments or decrements the up-and-down counter 2 depending upon the potential difference between the collector voltage Vc and the reference voltage REF. The up-and-down counter 2 is responsive to a clock signal for changing the value of an eight-bit digital output signal. Namely, when the comparator 1 instructs an increase/decrement of the digital value represented by the eight-bit digital output signal of the up-and-down counter 2, the up-and-down counter 2 repeats the increment/decrement of the digital value in response to the clock signal, and the increment/decrement at every clock pulse is "1".

The eight-bit digital output signal is supplied from the up-and-down counter 2 to the digital-to-analog converter 3, and the digital-to-analog converter 3 generates an analog control signal ALG corresponding to the eight-bit digital output signal. The analog control signal ALG is supplied to the level shifter 4, and the level shifter 4 shifts an RGB signal by the potential level represented by the analog control signal ALG.

The RGB signal regulated by the level shifter 4 is supplied to the base node of the bipolar transistor 8, and the bipolar transistor 8 drives the load or the cathode ray tube 7. The driving current is fed back to the comparator 1 as the collector voltage Vc, and the prior art automatic regulating circuit controls the RGB signal in such a manner as to match the collector voltage Vc to the reference voltage REF.

The prior art automatic regulating circuit counters a problem in the response time. The up-and-down counter 2 increments and decrements the eight-bit digital signal by "1" at every clock pulse. The prior art automatic regulating circuit completes the regulation within several clock pulses in so far as the potential difference between the collector voltage Vc and the reference voltage REF is small. However, if the potential difference is large, a substantial amount of time is consumed by the prior art automatic regulating circuit. For example, if the eight-bit digital signal is indicative of a neutral value, i.e., the mid point of 256 values and the target digital value is the maximum or the minimum of the eight-bit digital signal, the up-and-down counter 2 is expected to repeat the increment/decrement 128 times, and consumes 128 clock pulses.

Even though most of the regulation is completed within 10 clock pulses, the maximum time period corresponding to 128 clock pulses is shared to every regulation. If another signal processing follows the automatic regulation, the signal processing circuit is expected to quickly complete the given task, and the signal processing sequence becomes so tight.

SUMMARY OF THE INVENTION

It is therefore an important object of the present invention to provide an automatic regulating circuit which quickly regulates an actual level to a target level.

To accomplish the object, the present invention proposes to change a control signal in such a manner as to converge toward a target value corresponding to a reference level.

In accordance with the present invention, there is provided an automatic regulating circuit for regulating an output signal to a reference value, comprising: a comparator having a first input node supplied with the reference value and a second input node supplied with the output signal, and generating a comparative signal indicative of either higher or lower than the reference value; a binary searching unit responsive to the comparative signal so as to change the value of a control signal in such a manner as to converge toward a target value corresponding to the reference value in synchronism with a clock signal, the binary search unit determining the value of the control signal at nth clock pulse of the clock signal to be an intermediate value between the value of the control signal at (n-1)th clock pulse of the clock signal and the value of the control signal at (n-2)th clock pulse of the clock signal when the comparator changes the comparative signal between a first state indicating the output signal higher than the reference value and a second state indicating the output signal lower than the reference value, the binary search unit determining the value of the control signal at the nth clock pulse of the clock signal in the present of the comparative signal indicating one of the first state and the second state to be an intermediate value between the value of the control signal at the (n-1) clock pulse of the clock signal in the presence of the comparative signal indicating the other of the first state and the second state and the latest value of the control signal in the presence of the comparative signal indicating the one of the first state and the second state; and a shifting unit responsive to the control signal so as to change the output signal.

The automatic regulating circuit may regulate a potential level to a reference value.

BRIEF DESCRIPTION OF THE DRAWINGS

The features and advantages of the automatic regulating circuit according to the present invention will be more clearly understood from the following description taken in conjunction with the accompanying drawings in which.

DESCRIPTION OF THE PREFERRED EMBODIMENTS

First Embodiment

Figure 1:
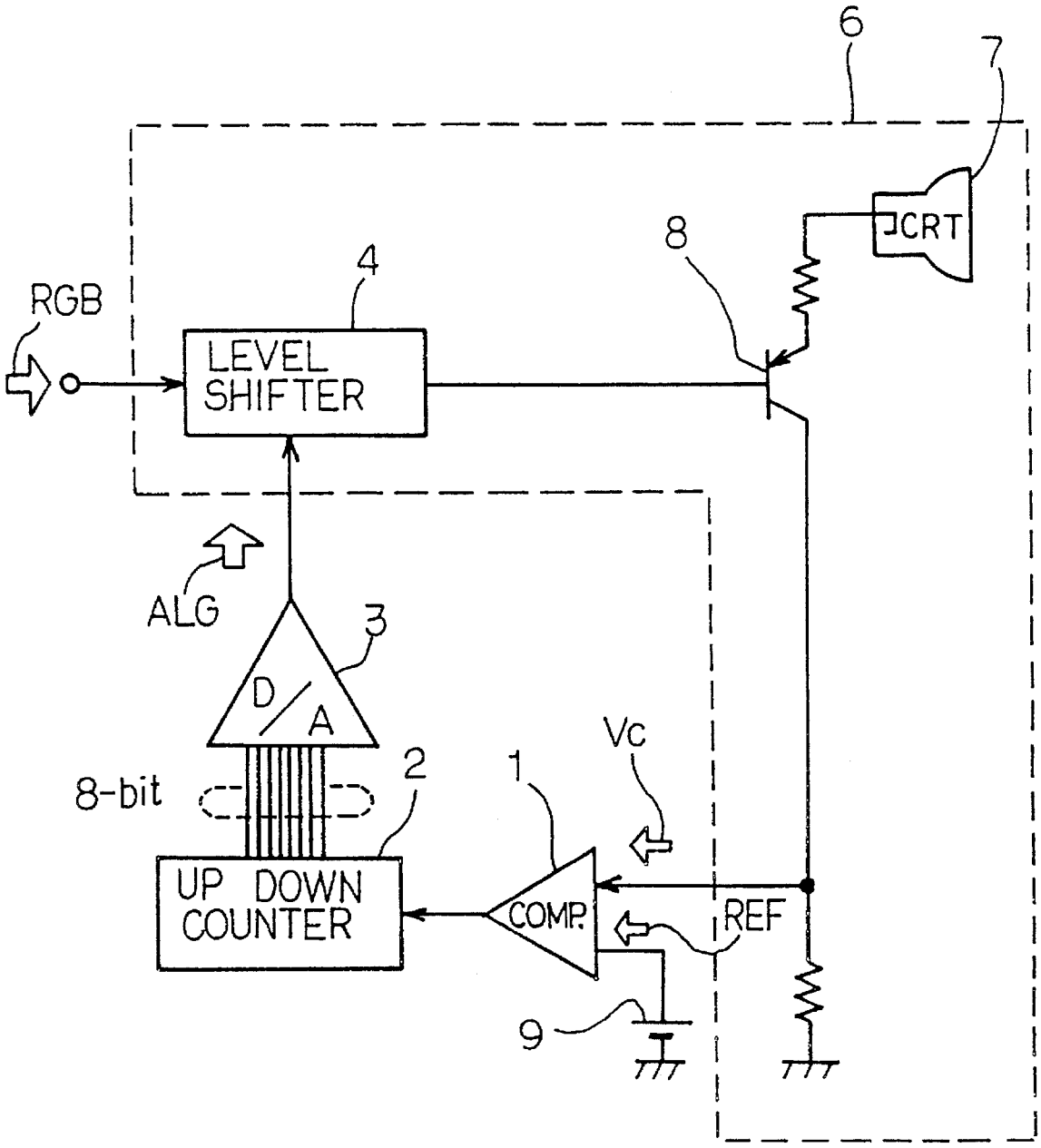
Fig. 1 PRIOR ART
FIG. 1 is a circuit diagram showing the arrangement of the prior art automatic regulating circuit.
Figure 2:
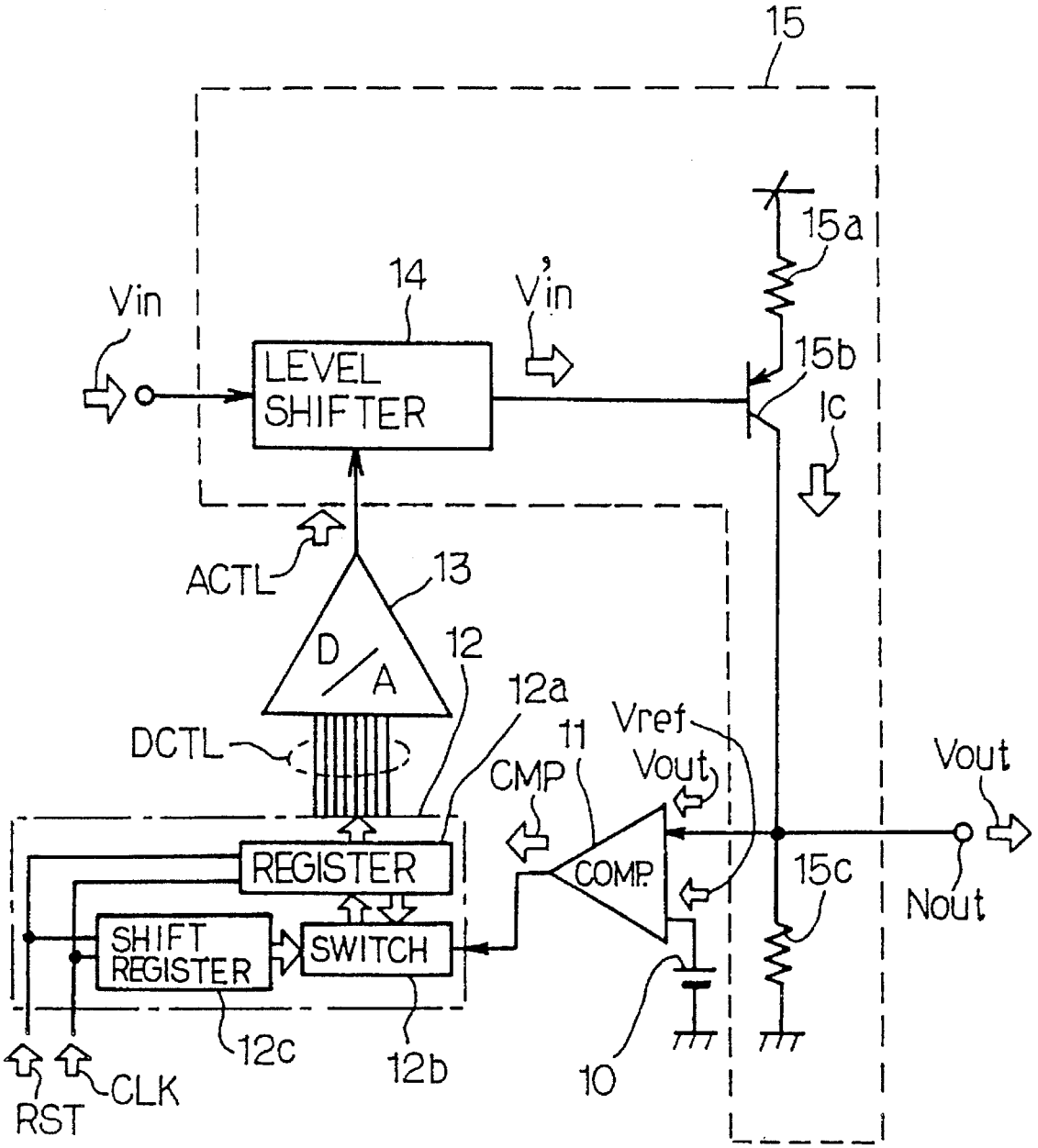
FIG. 2 is a circuit diagram showing the arrangement of an automatic regulating circuit according to the present invention.

Referring first to FIG. 2 of the drawings, an automatic regulating circuit embodying the present invention comprises a reference voltage source 10 for generating a reference voltage Vref and a comparator having input nodes connected to an output node Nout and the reference voltage source 10. The comparator 11 compares the output voltage signal Vout with the reference voltage Vref, and generates a comparative signal CMP indicative of a potential difference between the output voltage signal Vout and the reference voltage Vref. The reference voltage Vref is variable, and may range between 0.5 volt and 3.0 volts.

The automatic regulating circuit further comprises a binary search controller 12 responsive to the comparative signal CMP so as to changing an eight-bit digital control signal DCTL through a binary search sequence, a digital-to-analog converter 13 for converting the eight-bit digital control signal DCTL to an analog control signal ACTL and a level shifter 14 for shifting an input signal Vin. The level shifter 14 is incorporated in an output circuit 15, and a series of resistor 15*a*, a bipolar transistor 15*b* and a resistor 15*c* form the other part of the output circuit 15. The regulated input signal V'in is supplied to the base node of the bipolar transistor 15*b*, and the bipolar transistor 15*b* changes the collector current Ic1 in response to the regulated input signal V'in. The resistor 15*c* converts the collector current Ic1 to the output voltage Vout.

In this instance, the binary search controller 12 and the digital-to-analog converter 13 as a whole constitute a binary searching unit, and the level shifter 14, the resistors 15*a*/15*c* and the bipolar transistor 15*b* form in combination a shifting unit.

The binary search controller 12 gradually regulates the output voltage Vout toward the reference voltage Vref, and the regulating sequence is as follows. When the comparator 11 changes the comparative signal CMP at every clock pulse, the binary search controller 12 regulates the target output voltage Vout in such a manner as to have an intermediate value between the value at the previous clock pulse and the value at the clock pulse just before the previous clock pulse in so far as the sign is changed. If the sign is not changed, the binary search controller 12 sets the output voltage Vout to an intermediate value between the latest value with the opposite sign and the value at the previous clock pulse. In the first regulation, the binary search controller 12 regulates the new output voltage to an intermediate value between the output voltage Vout at the previous clock pulse and the maximum value Vmax in case of the output voltage Vout greater than the reference voltage Vref and an intermediate value between the output voltage Vout at the previous clock pulse and the minimum value Vmin in case of the output voltage Vout less than the reference voltage Vref.

The neutral value is set to an intermediate point between the maximum value Vmax and the minimum value Vmin, and the output voltage Vout is assumed to be changed from Vout(0) through Vout(1) to Vout(2). If the output voltage Vout(0) is grater than the reference voltage Vref, i.e., Vout(0)>Vref, the binary search logic controller 12 regulates the output voltage Vout(1) through the digital-to-analog converter 13, the level shifter 14 and the bipolar transistor 15*b* to an intermediate value between the output voltage Vout(0) and the maximum value Vmax. Subsequently, if the output voltage Vout(1) is still greater than the reference voltage Vref, i.e., Vout(1 )>Vref, the output voltage Vout(2) is regulated to an intermediate value between the Vout (0) and Vout (1), because the output voltage Vout(2) should be less than Vout(1). On the other hand, if the output voltage Vout(1) is less than the reference voltage Vref, Vout(1)<Vref, the output voltage Vout(2) is regulated to an intermediate value between Vout(1) and Vmax.

In this way, the new output voltage Vout is sequentially changed through the comparison between the present output voltage Vout and the reference voltage Vref in synchronism with the clock signal CLK, and the output voltage level Vout is finally matched with the reference voltage Vref at the eighth clock pulse.

The binary search controller 12 includes a register 12*a* for supplying the eight-bit digital control signal DCTL, a switch circuit 12*b* for selectively changing the value of the eight-bit digital control signal DCTL and a shift register 12*c* for selecting two bits to be changed from the eight-bit digital control signal DCTL. The register 12*a* changes the eight-bit digital control signal DCTL in synchronism with the clock signal CLK as follows.

Assuming now that the register 12*a* stores the eight-bit digital control signal DCTL of [10000000], the output voltage Vout(0) is initially regulated to the mid point of the voltage regulating range.

If the output voltage Vout(0) is higher than the reference voltage Vref, the switching circuit 12*b* adds "−1" to the second bit from the most significant bit MSB of the eight-bit digital control signal DCTL at the first clock pulse CLK(1) under the control of the shift register 12*c*, then the eight-bit digital control signal DCTL is changed to [01000000]. On the other hand, if the output voltage Vout(0) is lower than the reference voltage, the switching circuit 12*b* adds "+1" to the second bit from the most significant bit at the first clock pulse CLK(1) under the control of the shift register 12*c*, and the eight-bit digital control signal DCTL is changed to [11000000]. In the actual calculation, the switching circuit 12*b* supplies either "11" or "01" to the register 12*a* depending upon the comparative signal CMP, and the shift register 12*c* sequentially designates two bits of the eight-bit digital control signal DCTL from the most significant bit MSB toward the least significant bit LSB.

The switching circuit 12*b* repeats the same calculation for the third bit from the most significant bit MSB at the second clock pulse CLK(2) under the control of the shift register 12*c*. In this way, the switching circuit 12*b* sequentially repeats the same calculation for (n+1) bit from the most significant bit MSB at nth clock pulse under the control of the shift register 12*c*, and the least significant bit LSB is treated with the addition at seventh clock pulse CLK(7). When the addition is repeated seven times, the output voltage Vout(7) reaches the closest value to the reference voltage Vref.

Figure 3:
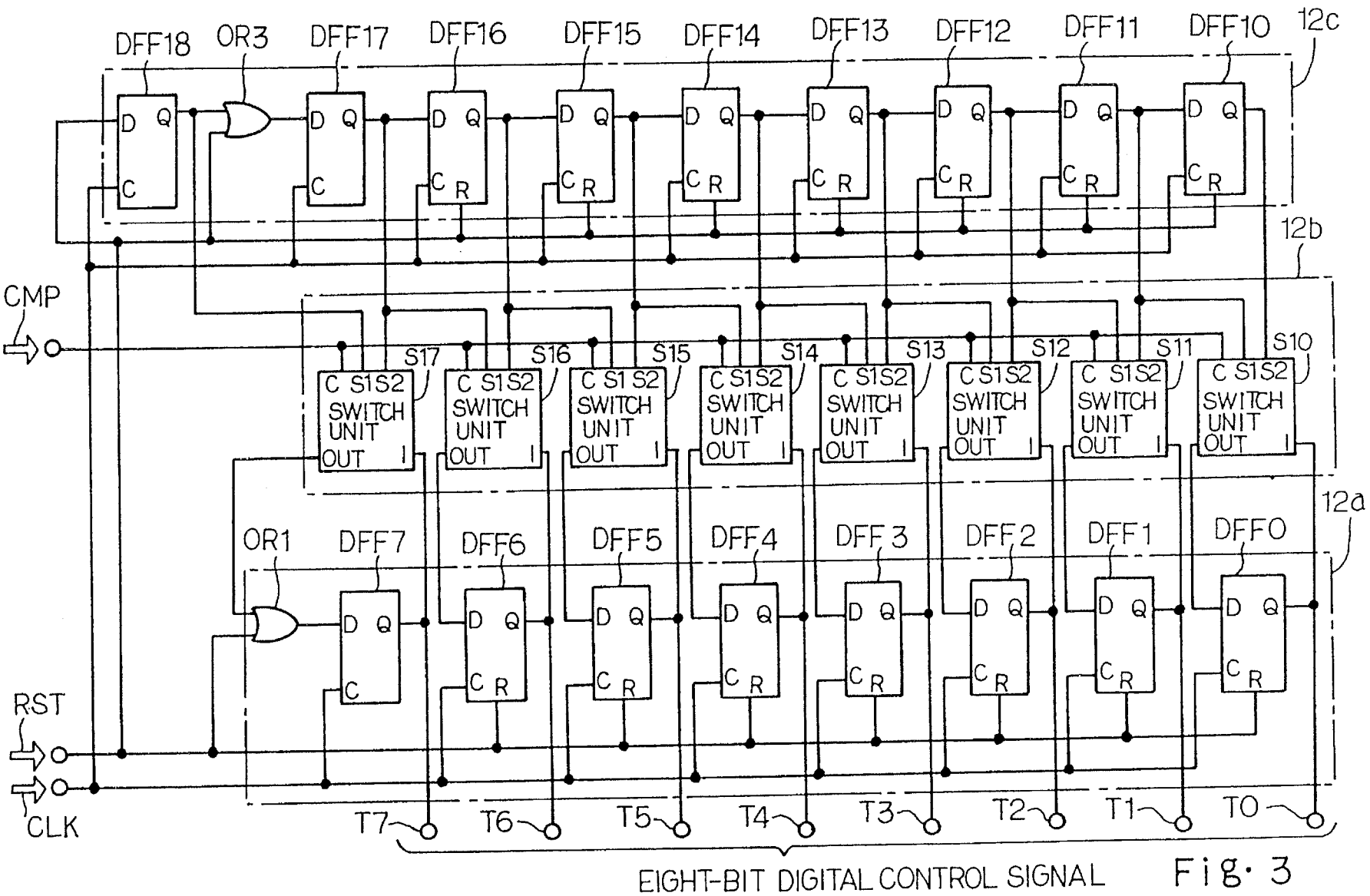
FIG. 3 is a circuit diagram showing a binary search logic circuit incorporated in the automatic regulating circuit.

FIG. 3 illustrates the circuit arrangement of the binary search controller 12. Eight D flip-flop circuits DFF0, DFF1, DFF2, DFF3, DFF4, DFF5, DFF6 and DFF7 and an OR gate OR1 form in combination the register 12*a*. The clock signal CLK is supplied in parallel to the clock node C of the eight D flip flop circuits DFF0 to DFF7, and the eight-bit digital control signal DCTL is supplied from the output nodes Q of the D flip flop circuits DFF0 to DFF7 to the output nodes T0 to T7. The reset signal RST is supplied to the reset nodes R of the D flip flop circuits DFF0 to DFF6. However, the reset signal RST is supplied through the OR gate OR1 to the D flip flop circuit DFF7 as will be described hereinlater.

Figure 4:
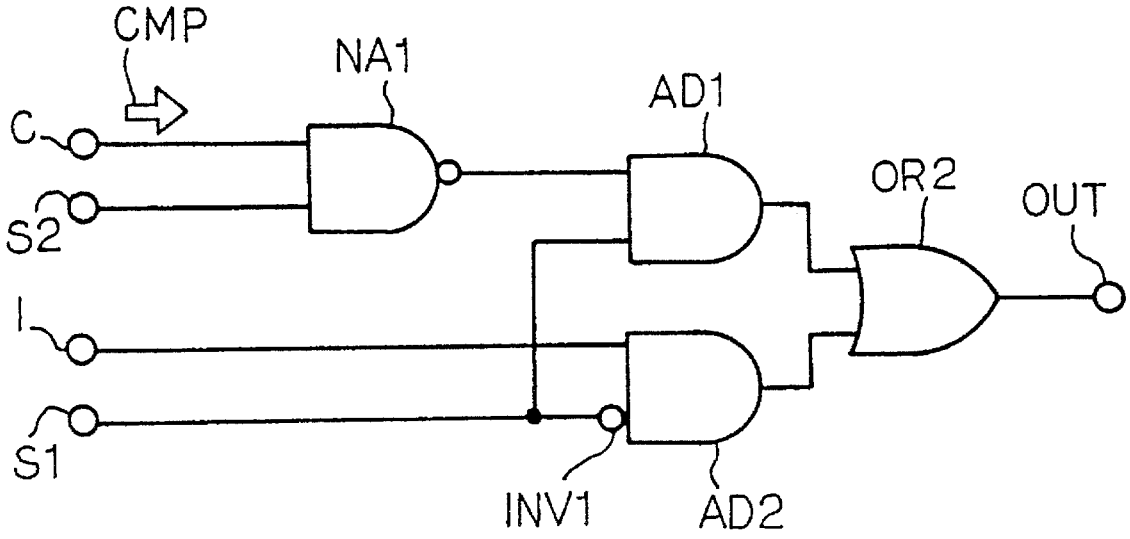
FIG. 4 is a circuit diagram showing the arrangement of a switching unit incorporated in the binary search logic circuit.

The switching circuit 12*b* includes eight switching units S10, S11, S12, S13, S14, S15, S16 and S17 respectively associated with the D flip flop circuits DFF0 to DFF7. A NAND gate NA1, two AND gates AD1 and AD2, an inverter INV1 and an OR gate OR2 are incorporated in each of the switching units S10 to S17 as shown in FIG. 4. The switching unit S10 to S17 has four input nodes C, S1, S2 and I and an output node OUT. The comparative signal CMP is supplied to the input nodes C of all the switching units S10 to S17, and the eight bits of the digital control signal DCTL are supplied in parallel from the output nodes Q of the D flip flop circuits DFF0 to DFF7 to the input nodes I of the switching units S10 to S17. As will be described hereinbelow, the shift register 12*c* produces nine-bit output signal, and the nine bits are selectively supplied to the input nodes S1/S2 of the switching units S10 to S17. The output nodes OUT of the switching units S10 to S16 are coupled in parallel to the input nodes D of the D flip flop circuits DFF0 to DFF6. The output node OUT of the remaining switching unit S17 is coupled to the OR gate OR1, and is ORed with the reset signal RST. The output node of the OR gate OR1 is supplied to the input node D of the D flip flop circuit DFF7.

The shift register 12*c* includes eight D flip flop circuits DFF10, DFF11, DFF12, DFF13, DFF14, DFF15, DFF16, DFF17 and DFF18 and an OR gate OR3, and the OR gate OR3 is coupled between the D flip flop circuits DFF18 and DFF17. The clock signal CLK is supplied to the clock nodes C of the D flip flop circuits DFF10 to DFF18, and the reset signal RST is supplied to the reset nodes of the D flip flop circuits DFF10 to DFF16, the input node D of the D flip flop circuit DFF18 and the OR gate OR3. The output node Q of the D flip flop circuit DFF18 is coupled to the OR gate OR3, and is Red with the reset signal RST. The output node of the OR gate OR3 is coupled to the input node D of the D flip flop circuit DFF17. The output nodes Q of the D flip flop circuits DFF17, DFF16, DFF15, DFF14, DFF13, DFF12 and DFF11 are respectively coupled to the input nodes D of the adjacent D flip flop circuits DFF16, DFF15, DFF14, DFF13, DFF12, DFF11 and DFF10.

Adjacent two D flip flop circuits are selected from the D flip flop circuits DFF10 to DFF18, and the D flip flop circuits DFF10 to DFF18 form eight groups.

The first group is constituted by the D flip flop circuits DFF10 and DFF11, and the output nodes Q of the D flip flop circuits DFF11 and DFF10 are coupled in parallel to the input nodes S1 and S2 of the switching circuit S10.

The second group is constituted by the D flip flop circuits DFF11 and DFF12, and the output nodes Q of the D flip flop circuits DFF12 and DFF11 are coupled in parallel to the input nodes S1 and S2 of the switching circuit S11.

The third group is constituted by the D flip flop circuits DFF12 and DFF13, and the output nodes Q of the D flip flop circuits DFF13 and DFF12 are coupled in parallel to the input nodes S1 and S2 of the switching circuit S12.

The fourth group is constituted by the D flip flop circuits DFF13 and DFF14, and the output nodes Q of the D flip flop circuits DFF14 and DFF13 are coupled in parallel to the input nodes S1 and S2 of the switching circuit S13.

The fifth group is constituted by the D flip flop circuits DFF14 and DFF15, and the output nodes Q of the D flip flop circuits DFF15 and DFF14 are coupled in parallel to the input nodes S1 and S2 of the switching circuit S14.

The sixth group is constituted by the D flip flop circuits DFF15 and DFF16, and the output nodes Q of the D flip flop circuits DFF16 and DFF15 are coupled in parallel to the input nodes S1 and S2 of the switching circuit S15.

The seventh group is constituted by the D flip flop circuits DFF16 and DFF17, and the output nodes Q of the D flip flop circuits DFF17 and DFF16 are coupled in parallel to the input nodes S1 and S2 of the switching circuit S16.

Finally, the eighth group is constituted by the D flip flop circuits DFF17 and DFF18, and the output nodes Q of the D flip flop circuits DFF18 and DFF17 are coupled in parallel to the input nodes S1 and S2 of the switching circuit S17.

When the automatic regulating circuit starts the potential regulation, the reset signal RST is changed to logic "1" level. Then, the reset signal of logic "1" level reaches the input nodes of the D flip flop circuits DFF18 and DFF17, the reset nodes R of the D flip flop circuits DFF16 to DFF10 and the input node D of the D flip flop circuit DFF7. The D flip flop circuits DFF10 to DFF18 and DFF0 to DFF7 latches the logic levels at the input nodes D in synchronism with the first clock pulse CLK. Then, the D flip flop circuits DFF7 to DFF0 supply the eight-bit digital control signal DCTL of [10000000] to the output nodes T7 to T0, and the D flip flop circuits DFF18/DFF17 and the other D flip flop circuits DFF16 to DFF10 produce the output bits of [11000000]. The reset signal RST is recovered from logic "1" level to logic "0" level, and is maintained in logic "0" level during the voltage regulation.

If the output voltage Vout is higher than the reference voltage Vref, the comparative signal CMP is logic "1" level. On the other hand, the comparative signal CMP of logic "0" level is indicative of the output signal Vout lower than the reference voltage Vref.

The output voltage Vout is assumed to be lower than the reference voltage Vref. As to the switching unit S17, the input nodes S1, S2 and I are at logic "1" level, and the input node C is logic "0" level. In this situation, the NAND gate NA1 produces logic "1", and logic "1" at the input node S1 allows the AND gate AD1 to transfer logic "1" to the OR gate OR2. For this reason, the OR gate OR2 yields logic "1" level at the output node OUT of the switching unit S17 regardless of the output of the AND gate AD2.

As to the switching unit S16, the input nodes S1, S2, I and C are in logic "1", logic "0", logic "0" and logic "0". The NAND gate NA1 yields logic "1" level, and the logic "1" level at the input node S1 allows the AND gate AD1 to transfer logic "1" to the OR gate OR2. Then, the OR gate OR2 provides logic "1" level to the output node OUT of the switching unit S16 regardless of the output of the AND gate AD2.

On the other hand, if the output voltage Vout is higher than the reference voltage, the comparative signal CMP is in logic "1", and the switching units S17 and S16 produce logic "0" and logic "1".

As to each of the switching units S15 to S10, the input nodes S1, S2 and I are in logic "0" level. Logic "0" at the input node I causes the AND gate AD2 to produce logic "0", and logic "0" at the input node S1 causes the AND gate AD1 to yield logic "0" regardless of the comparison signal CMP. Thus, logic "0" is supplied to both inputs of the OR gate OR2, and the switching units S15 to S10 produce logic "0" levels at the output nodes OUT thereof.

The register 12*a* latches the output of the switching circuit 12*b* in synchronism with the second clock signal CLK. The eight-bit digital control signal DCTL is [11000000] in case of the output voltage Vout lower than the reference voltage, and is an intermediate value between the previous value [10000000] and the maximum value [11111111]. On the other hand, the output voltage Vout higher than the reference voltage Vref results in the eight-bit digital control signal DCTL of [01000000] which is an intermediate value between the previous value [10000000] and the minimum value [00000000]. The eight-bit digital control signal DCTL is supplied to the output nodes T7 to T0.

The D flip flop circuits DFF18 and DFF17 transfer logic "1" levels to the D flip flop circuits DFF17 and DFF16, and the D flip flop circuit DFF18 latches logic "0" level at the reset node of the D flip flop circuit DFF10 in synchronism with the second clock pulse. Thus, the shift register 12*c* changes the output to [011000000] in synchronism with the second clock pulse CLK. If the output voltage Vout is still lower than the reference voltage Vref, the comparative signal CMP is still maintained in logic "0" level.

As to the switching unit S17, logic "1" level and logic "0" level are supplied to the input nodes S2 and I and the input nodes S1 and C. The inverter INV1 causes the AND gate AD2 to produce logic "1" in the presence of logic "1" level at the input node I, and the OR gate OR2 produces logic "1" level regardless of the output of the AND gate AD1. As a result, the switching unit S17 yields the output of logic "1" level at the output node OUT thereof.

As to the switching unit S16, logic "1" level and logic "0" level are supplied to the input nodes S1, S2 and I and the input node C. The NAND gate NA1 produces logic "1", and logic "1" at the input node S1 allows the AND gate AD1 to transfer logic "1" level to the OR gate OR2. The OR gate OR2 transfers logic "1" to the output node OUT regardless of the output of the AND gate AD2. As a result, the switching unit S16 produces logic "1" at the output node OUT thereof.

As to the switching unit S15, logic "1" level and logic "0" level are supplied to the input node S1 and the input nodes S2, I and C. The NAND gate NA1 yields logic "1", and logic "1" at the input node S1 allows the AND gate AD1 to transfer logic "1" to the OR gate OR2. The OR gate OR2 produces logic "1" regardless of the output of the AND gate AD2. Thus, the switching unit S15 yields logic "1" level at the output node OUT thereof.

As to each of the switching units S14 to S10, logic "0" level is supplied to all of the input nodes S1, S2, I and C. Although the NAND gate NA1 produces logic "1", logic "0" at the input node S1 causes the AND gate AD1 to change logic "1" of the NAND gate NA1 to logic "0". Logic "0" at the input node I causes the AND gate AD2 to yield logic "0" level. As a result, the OR gate OR2 supplies logic "0" level to the output node OUT of each of the switching units S13 to S10.

Thus, the switching circuit 12*b* supplies the output of [11100000] to the register 12*a*, and the register 12*a* latches the output of the switching circuit 12*b* in synchronism with the third clock pulse CLK. The eight-bit digital control signal DCTL has the value [11100000] between the previous value [11000000] and the maximum value [11111111], because the comparative signal CMP is assumed not to change the logic level.

The shift register 12*c* changes the output to [00110000] in synchronism with the third clock pulse CLK. The comparative signal CMP is assumed to be changed from logic "0" to logic "1" level. The switching circuit 12*b* changes the outputs as follows.

As to the switching unit S17, logic "1" level and logic "0" level are supplied to the input nodes I and C and the input nodes S1 and S2. The inverter INV1 causes the AND gate AD2 to produce logic "1" level in the presence of logic "1" at the input node I, and the OR gate transfers logic "1" level to the output node OUT of the switching unit S17 regardless of the output of the AND gate AD1. As a result, the switching unit S17 yields logic "1" at the output nodes OUT.

As to the switching unit S16, logic "1" level and logic "0" level are supplied to the input nodes S2, I and C and the input node S1. The inverter INV1 causes the AND gate AD2 to produce logic "1" in the presence of logic "1" at the input node I, and the OR gate OR2 transfers logic "1" to the output node OUT of the switching unit S16 regardless of the output of the AND gate AD1. Thus, the switching unit S16 yields logic "1" at the output node OUT thereof.

As to the switching unit S15, logic "1" level are supplied to all of the input nodes S1, S2, I and C. The NAND gate NA1 produces logic "0" level, and the AND gate AD1 supplies logic "0" to the OR gate OR2. The inverter INV1 causes the AND gate AD2 to produce logic "0", and the AND gate AD2 supplies logic "0" to the OR gate OR2. Logic "0" at both input nodes of the OR gate OR2 results in logic "0" level at the output node OUT of the switching unit S15. Thus, the switching unit S15 yields logic "0" level at the output node OUT thereof.

As to the switching unit S14, logic "1" level and logic "0" level are supplied to the input nodes S1 and C and the input nodes S2 and I. The NAND gate NA1 produces logic "1", and the AND gate AD1 transfers logic "1" to the OR gate OR2 in the presence of logic "1" at the input node S1. For this reason, the OR gate OR2 transfers logic "1" to the output node OUT regardless of the output of the AND gate AD2, and the switching unit S14 yields logic "1" at the output node OUT thereof.

As to the switching units S13 to S10, logic "1" level and logic "0" level are supplied to the input node C and the input nodes S1, S2 and I. Logic "0" at the input node S1 and logic "0" at the input node I cause the AND gates AD1 and AD2 to produce logic "0", and the OR gate OR2 transfers logic "0" to the output node OUT. Thus, the switching units S13 to S10 yield logic "0" at the output nodes OUT thereof.

Thus, the switching circuit 12*b* supplies the output of [11010000] to the register 12*a*, and the register 12*a* latches the output of [11101000] in synchronism with the fourth clock signal CLK. The eight-bit digital control signal DCTL has the value [11010000] between the previous two values, i.e., [11000000] and [11100000], because the comparative signal CMP changes the logic level from "0" to "1".

The shift register 12*c* changes the output to [000110000] in synchronism with the fourth clock pulse CLK, and the comparative signal CMP is assumed to change the logic level from "1" to "0". The output of the switching circuit 12*b* becomes as follows.

As to each of the switching units S17 and S16, logic "1" and logic "0" are supplied to the input node I and the input nodes S1, S2 and C. The inverter INV1 causes the AND gate AD2 to produce logic "1" in the presence of logic "1" at the input node I, and the OR gate OR2 transfers logic "1" to the output node OUT regardless of the output of the AND gate AD1. For this reason, the switching units S17 and S16 yield logic "1" at the output nodes OUT thereof.

As to the switching unit S15, logic "1" and logic "0" are supplied to the input node S2 and the input nodes S1, I and C. Logic "0" at the input node S1 causes the AND gate AD1 to produce logic "0" regardless of the output of the NAND gate NA1, and logic "0" at the input node I also causes the AND gate AD2 to produce logic "0". Logic "0" is supplied to both inputs of the OR gate OR2, and the OR gate OR2 supplies logic "0" to the output node OUT. Thus, the switching unit S15 yields logic "0" at the output node OUT thereof.

As to the switching unit S14, logic "1" and logic "0" are supplied to the input node S1, S2 and I and the input node C. The NAND gate NA1 produces logic "1" level, and logic "1" level at the input node S1 allows the AND gate AD1 to transfer logic "1" level to the OR gate OR2. The OR gate OR2 supplies logic "1" level to the output node OUT regardless of the output of the AND gate AD2, and the switching unit S14 yields logic "1" level at the output node OUT thereof.

As to the switching unit S13, logic "1" and logic "0"are supplied to the input node S1 and the input nodes S2, I and C. The NAND gate NA1 produces logic "1", and logic "1" at the input node S1 allows the AND gate AD1 to transfer logic "1" to the OR gate OR2. As a result, the OR gate OR2 supplies logic "1" to the output node OUT regardless of the output of the AND gate AD2. Thus, the switching unit S13 yields logic "1" level at the output node OUT thereof.

As to the switching units S12 to S10, logic "0" is supplied to all of the input nodes S1, S2, I and C. Logic "0" level at the input nodes S1 and I causes the AND gates AD1 and AD2 to produce logic "0" level, and the OR gate OR2 supplies logic "0" to the output node OUT. Thus, the switching units S12 to S10 yield logic "0" at the output nodes OUT thereof.

The switching circuit 12*b* supplies the output of [1101000] to the register 12*a*, and the register 12*a* latches the output of [11011000] in synchronism with the fifth clock pulse CLK. The eight-bit digital control signal DCTL has the value [110111000] between the latest value [11100000] in the presence of the comparative signal CMP of logic "0" level and the previous value of [11010000].

In this way, the shift register 12*c* transfers the two logic "1" bits from the eighth group to the first group in synchronism with the clock signal CLK, and the switching units S10 to S17 change the logic levels at the respective output nodes OUT through the logical operation on the previous value of the digital control signal DCTL, the two bits S1 and S2 supplied from the shift register 12*c* and the comparative signal CMP. The register 12*a* latches the logic levels at the output nodes OUT in synchronism with the clock signal CLK, and the eight bit digital control signal DCTL is changed for the binary search.

Figure 6:
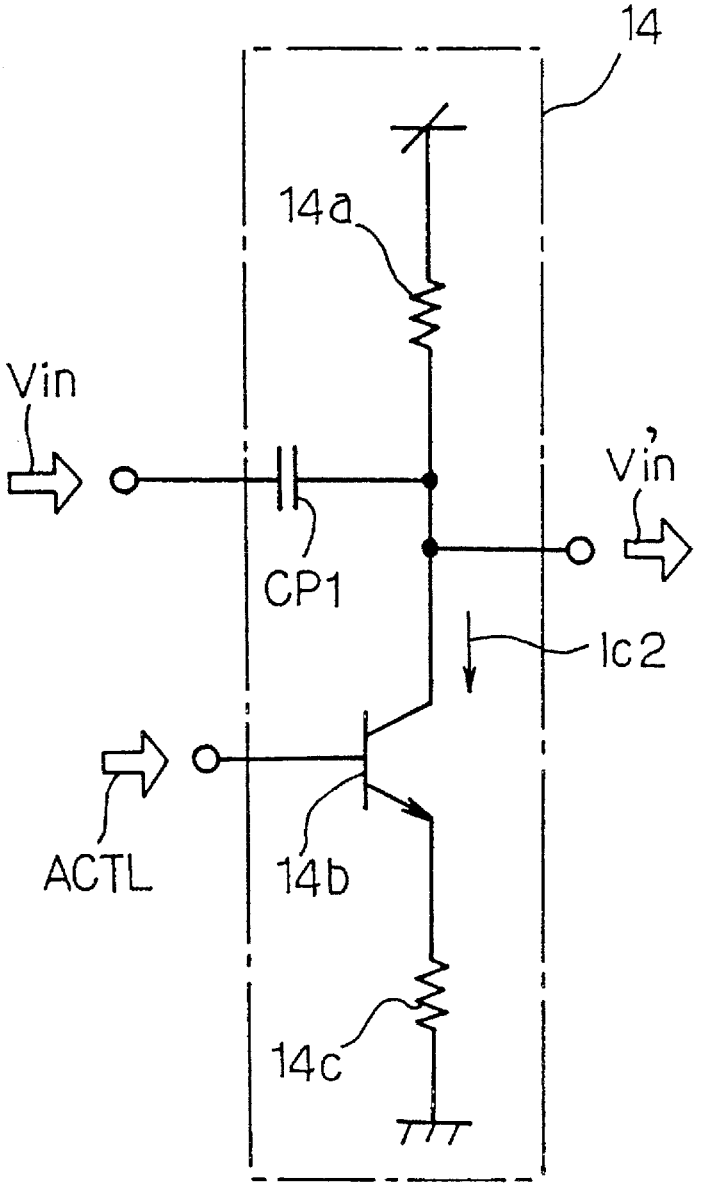
FIG. 6 is a circuit diagram showing the arrangement of a level shifter incorporated in the automatic regulating circuit.

Turning to FIG. 6 of the drawings, the level shifter 14 includes a capacitor CP1 and a series of resistor 14*a*, a bipolar transistor 14*b* and a resistor 14*c* coupled between a positive power voltage line and a ground voltage line, and the capacitor CP1 is coupled between the input node for the input voltage signal Vin and the collector node of the bipolar transistor 14*b*. The regulated input voltage signal V'in appears at the collector node of the bipolar transistor 14*b*. The analog control signal ACTL is supplied to the base node of the bipolar transistor 14*b*.

If the binary search controller 12 changes the eight-bit digital control signal DCTL and, accordingly, the digital-to-analog converter 13 changes the analog control signal ACTL, the bipolar transistor 14*b* changes the collector current Ic2, and the resistor 14*a* changes the potential drop depending upon the amount of the collector current Ic2. As a result, the regulated input signal V'in varies the potential level as given by equation 1.

$$V'in=Vcc-R1\times Ic2 \qquad \text{Equation 1}$$

where Vcc is the potential level on the positive power voltage line and R1 is the resistance of the resistor 14*a*. Thus, the level shifter 14 changes the potential level of the input voltage signal Vin in response to the analog control signal ACTL.

Figure 5:
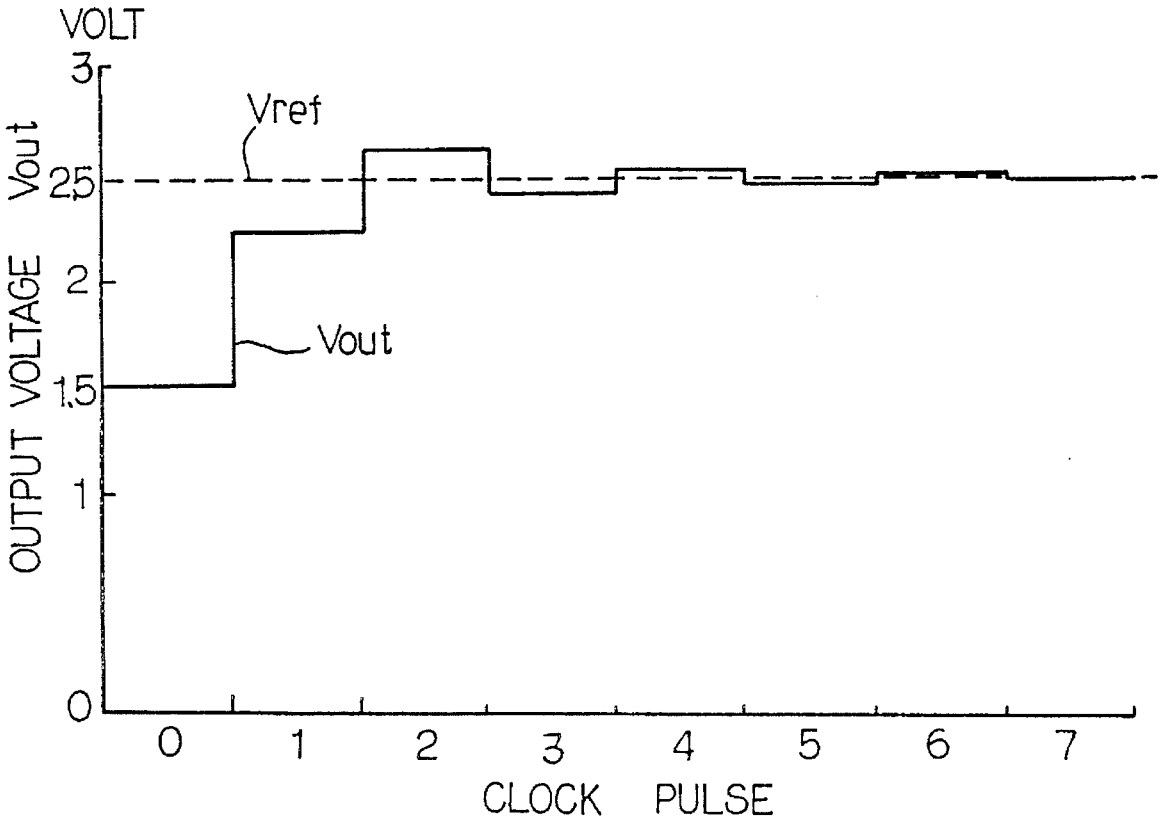
FIG. 5 is a graph showing an output voltage in terms of an clock pulse.

With the eight-bit digital control signal DCTL, the level shifter 14 regulates the output voltage Vout in cooperation with the bipolar transistor 15*b* as follows. First we assume that the reference voltage Vref, the initial output voltage Vout(0), the maximum voltage Vmax and the minimum voltage Vmin are 2.5 volts, 1.5 volts, 3.0 volts and 0 volt, respectively, and FIG. 5 illustrates the voltage regulation on the output voltage Vout.

After the reset signal RST is supplied to the shift register 12*c* and the register 12*a*, the eight-bit digital control signal DCTL is changed to [10000000] in synchronism with the first clock pulse CLK(0), and the digital-to-analog converter 13 converts the eight-bit digital control signal DCTL of [10000000] to the corresponding analog control signal ACTL. The level shifter 14 changes the input voltage signal from Vin to V'in, and causes the bipolar transistor 15*b* to change the collector current Ic. The collector current Ic is converted to the output voltage Vout(0) corresponding to the eight-bit digital control signal DCTL of [10000000], and is 1.5 volt.

The output voltage Vout(0) is lower than the reference voltage Vref, and the switching circuit 12*b* changes the output thereof to [11000000]. The register 12*a* latches the output of the switching circuit 12*b* in synchronism with the second clock signal CLK(1), and the level shifter 14 and the bipolar transistor 15*b* changes the collector current Ic to the value corresponding to the eight-bit digital control signal DCTL. As a result, the output voltage Vout(1) is regulated to (Vout(0)+Vmax)/2=2.25 volts.

The output voltage Vout(1) is still lower than the reference voltage Vref, and the switching circuit 12*b* changes the output thereof to [11100000]. The register 12*a* latches the output of the switching circuit 12*b* in synchronism with the third clock signal CLK(2), and the level shifter 14 and the bipolar transistor 15*b* changes the collector current Ic to the value corresponding to the eight-bit digital control signal DCTL. As a result, the output voltage Vout(2) is regulated to (Vout(1)+Vmax)/2=2.63 volts.

The output voltage Vout(2) is higher than the reference voltage Vref, and the switching circuit 12*b* changes the output thereof to [11010000]. The register 12*a* latches the output of the switching circuit 12*b* in synchronism with the fourth clock signal CLK(3), and the level shifter 14 and the bipolar transistor 15*b* changes the collector current Ic to the value corresponding to the eight-bit digital control signal DCTL. As a result, the output voltage Vout(3) is regulated to (Vout(2)+Vout(1))/2=2.44 volts.

The output voltage Vout(3) is lower than the reference voltage Vref, and the switching circuit 12*b* changes the output thereof to [11011000]. The register 12*a* latches the output of the switching circuit 12*b* in synchronism with the fifth clock signal CLK(4), and the level shifter 14 and the bipolar transistor 15*b* change the collector current Ic to the value corresponding to the eight-bit digital control signal DCTL. As a result, the output voltage Vout(4) is regulated to (Vout(3)+Vout(2))/2=2.53 volts.

The output voltage Vout(4) is higher than the reference voltage Vref, and the switching circuit 12*b* changes the output thereof to [11010100]. The register 12*a* latches the output of the switching circuit 12*b* in synchronism with the sixth clock signal CLK(5), and the level shifter 14 and the bipolar transistor 15*b* change the collector current Ic to the value corresponding to the eight-bit digital control signal DCTL. As a result, the output voltage Vout(5) is regulated to (Vout(4)+Vout(3))/2=2.49 volts in response to the sixth clock pulse CLK(5).

The output voltage Vout(5) is lower than the reference voltage Vref, and the switching circuit 12*b* changes the output thereof to [11010110]. The register 12*a* latches the output of the switching circuit 12*b* in synchronism with the seventh clock signal CLK(6), and the level shifter 14 and the bipolar transistor 15*b* change the collector current Ic to the value corresponding to the eight-bit digital control signal DCTL. As a result, the output voltage Vout (6) is regulated to ( Vout (5)+Vout(4))/2=2.51 volts in response to the seventh clock pulse CLK (6).

The output voltage Vout(6) is higher than the reference voltage Vref, and the switching circuit 12*b* changes the output thereof to [11010101]. The register 12*a* latches the output of the switching circuit 12*b* in synchronism with the eighth clock signal CLK(7), and the level shifter 14 and the bipolar transistor 15*b* change the collector current Ic to the value corresponding to the eight-bit digital control signal DCTL. As a result, the output voltage Vout(7) is regulated to (Vout(6)+Vout(5))/2 =2.50 volt in response the eighth clock pulse CLK(7).

The switching circuit 12*b* shifts two bits from the most significant bit MSB to the least significant bit LSB in synchronism with the clock signal CLK, and the two bits are changed to "11" or "01" depending upon the comparative signal CMP. In the above described example, the two bits are changed as follows.

| clock pulse | DCTL |
|---|---|
| first | 10000000 |
| second | 11000000 |
| third | 11100000 |
| fourth | 11010000 |
| fifth | 11011000 |
| sixth | 11010100 |
| seventh | 11010110 |
| eighth | 11010101 |

As will be understood from the foregoing description, the binary search controller 12 changes the value of the eight-bit control signal across a target value corresponding to the reference voltage Vref in synchronism with the clock signal CLK, and the value of the eight-bit control signal converges at the target value. Accordingly, the level-shifter 14 and the bipolar transistor 15*b* changes the output voltage Vout in response to the analog control signal formed from the eight-bit digital control signal, and the output voltage Vout also converges at the reference voltage Vref. The automatic regulating circuit according to the present invention completes the voltage regulation at eighth clock pulse at all times, and regulates the output voltage Vout to the reference voltage Vref faster than the prior art automatic regulating circuit. Even if another signal processing follows, the designer can share long time period to the signal processing, and the circuit design becomes easier.

Second Embodiment

Figure 7:
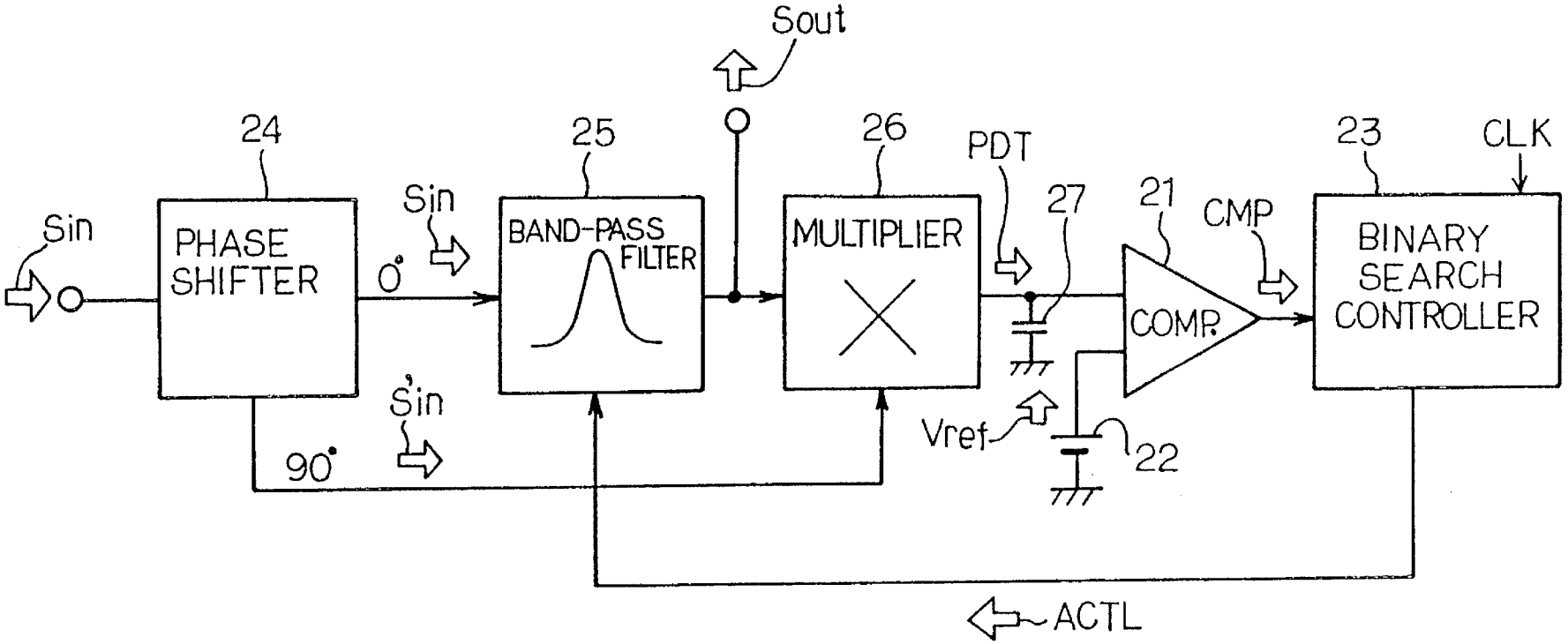
FIG. 7 is a circuit diagram showing another automatic regulating circuit according to the present invention.

Turning to FIG. 7 of the drawings, another automatic regulating circuit embodying the present invention is used for a frequency regulation. The automatic regulating circuit comprises a comparator 21, a reference voltage source 22, a binary search controller 23, a phase shifter 24, a band-pass filter 25, a multiplier 26 and a capacitor 27. The comparator 21 and the reference voltage source 22 are similar to those of the first embodiment.

The phase shifter 24 shifts the phase of an input signal Sin by 90 degrees, and supplies an phase-shifted signal S'in to the multiplier 26. The input signal Sin is transferred from the phase shifter 24 to the band-pass filter 25, and the band-pass filter 25 produces an output signal Sout under the control of the binary search controller 23. The multiplier 26 multiplies the output signal Sour by the phase-shifted signal S'in, and the multiplier 26 supplies a product signal PDT to the capacitor 27, and the capacitor 27 smoothen the product signal PDT. The product signal PDT is supplied through the capacitor 27 to the comparator 21. The comparator compares the product signal PDT with the reference voltage signal Vref, and supplies a comparative signal CMP indicative of a potential difference between the product signal PDT and the reference voltage signal Vref. The potential difference between the product signal PDT and the reference voltage signal Vref represents an offset of the center frequency f0 in the band-pass filter 25.

The binary search controller 23 changes the value of a digital control signal across a target value corresponding to the reference voltage Vref, and the digital control signal converges at the target as similar to the first embodiment.

After conversion into an analog control signal ACTL, the binary search controller 23 supplies the analog control signal ACTL to the control node of the band-pass filter 25, and the band-pass filter 25 regulates the center frequency thereof f0.

If the frequency of the input signal Sin is equal to the center frequency f0, the phase of the output signal Sout is zero degree. However, if the frequency of the input signal Sin is offset from the center frequency f0, the phase of the output signal Sour is changed depending upon the magnitude of the offset.

Figure 8:
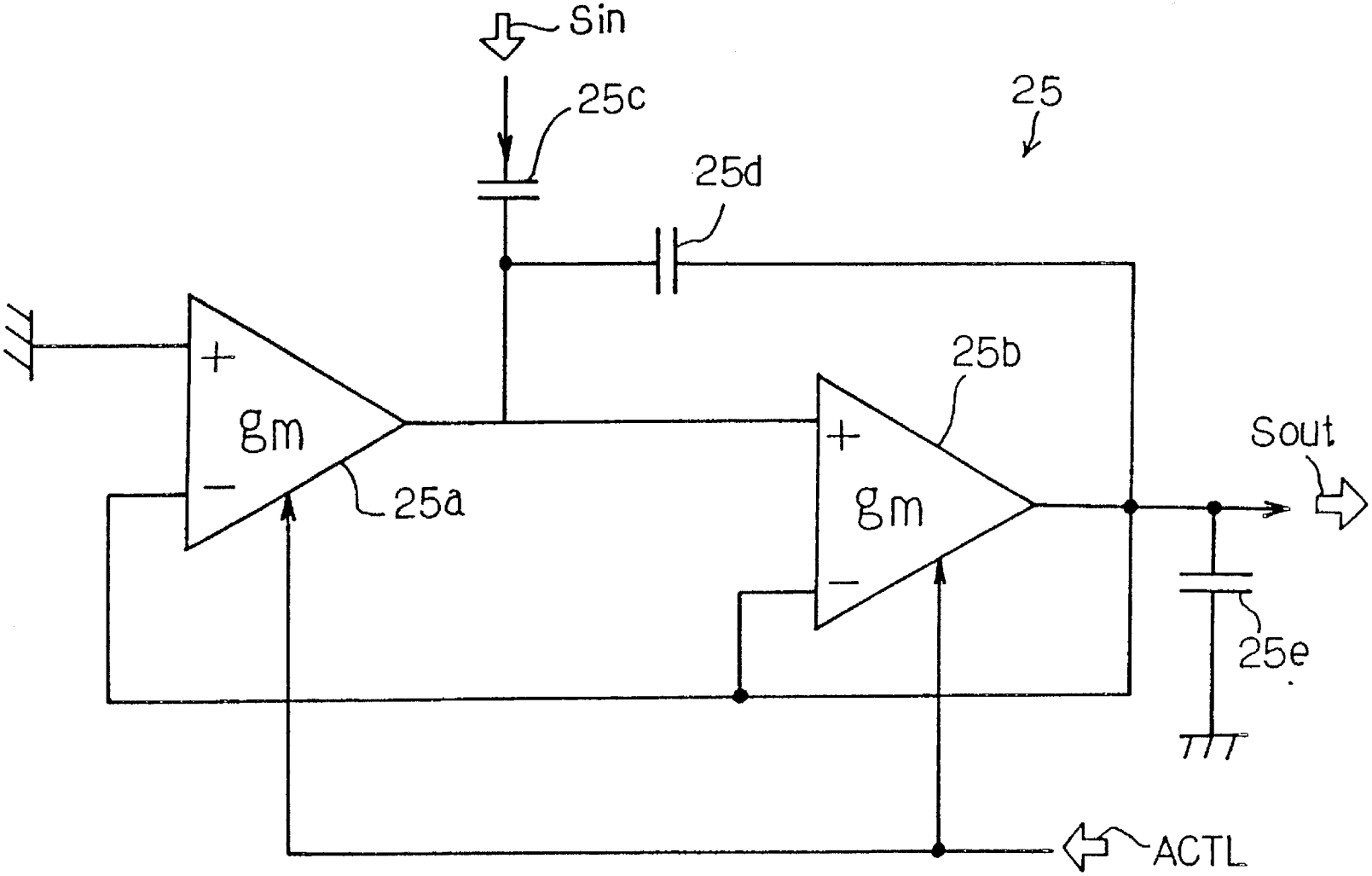
FIG. 8 is a circuit diagram showing the arrangement of a band-pass filter incorporated in the automatic regulating circuit shown in FIG. 7.

The band-pass filter 25 is arranged in such a manner as to control the center frequency f0 with the analog control signal ACTL. FIG. 8 illustrates the arrangement of the band-pass filter 25. Two operational amplifiers 25*a* and 25*b* and three capacitors 25*c*, 25*d* and 25*e* form in combination an active filter for the band-pass filter 25, and the transconductance gm of the operational amplifiers 25*a* and 25*b* is controlled by the analog control signal ACTL.

The transfer function of the active filter 25 is given by equation 2.

$$x=S1/\{S2(S1+S3)+S1+1\} \qquad \text{equation 2}$$

where "1" is the input, x is the output and S1, S2 and S3 are transfer functions of the capacitors 25*c*, 25*e* and 25*d*.

Figure 9:
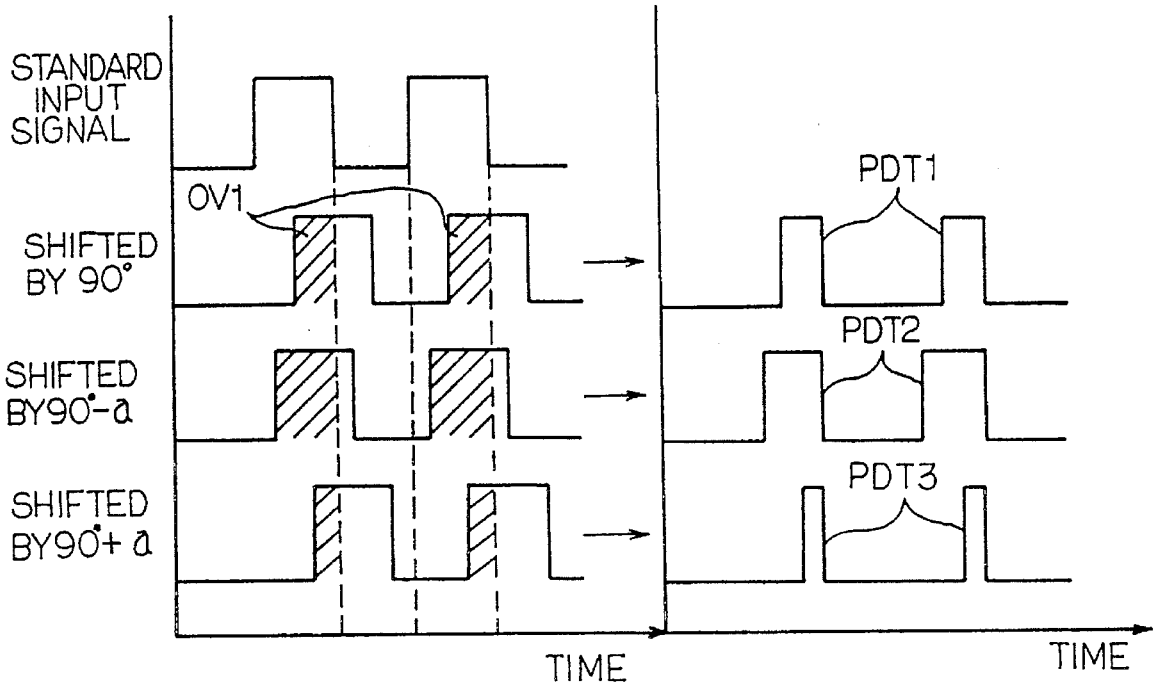
FIG. 9 is a diagram showing a function of a multiplier incorporated in the automatic regulating circuit shown in FIG. 7.

FIG. 9 shows the function of the multiplier 26. If the output signal S' in is exactly shifted by 90 degrees, the multiplier 26 produces the product signal PDT1 corresponding to the overlapped portion OV1 between the input signal Sin and the phase-shifted signal S' in.

However, if the output signal S'in is shifted by (90–a) degrees, the multiplier 26 produces the product signal PDT2 wider than the standard product signal PDT1. On the other hand, if the output signal S'in is shifted by (90+a) degrees, the multiplier 26 produces the product signal PDT3 narrower than the standard product signal PDT1. For this reason, after the smoothening by the capacitor 27, the potential level of the product signal PDT is indicative of the phase difference, and the comparator 21 compares the potential level of the product signal PDT with the reference voltage Vref.

The reference voltage Vref is calculated through the integration between the capacitance of the capacitor 27 and the standard product signal PDT at the cycle frequency of the input signal matched with the center frequency of the band-pass filter 25.

The automatic regulating circuit thus arranged quickly regulates the output signal Sour to the standard input signal, and the phase shifter 24, the band-pass filter 25, the multiplier 26 and the capacitor 27 form in combination a shifting unit.

As will be appreciated from the foregoing description, the binary search controller quickly regulates the output signal to a reference value in cooperation with the shifting unit.

Although particular embodiments of the present invention have been shown and described, it will be obvious to those skilled in the art that various changes and modifications may be made without departing from the spirit and scope of the present invention.

For example, the binary search controller may supply a digital control signal more than eight bits to the digital-to-analog converter 13. The bits of the digital control signal is dependent on the resolution for the potential control range, and is optimized on the balance between the resolution and the response time.

What is claimed is:

1. An automatic regulating circuit for regulating an output signal to a reference value, comprising:

a comparator having a first input node supplied with said reference value and a second input node supplied with said output signal, and generating a comparative signal indicative of either higher or lower than said reference value;

a binary searching unit responsive to said comparative signal so as to change the value of a control signal in such a manner as to converge toward a target value corresponding to said reference value in synchronism with a clock signal, said binary search unit determining the value of said control signal at nth clock pulse of said clock signal to be an intermediate value between the value of said control signal at (n-1)th clock pulse of said clock signal and the value of said control signal at (n-2)th clock pulse of said clock signal when said comparator changes the comparative signal between a first state indicating said output signal higher than said reference value and a second state indicating said output signal lower than said reference value, said binary search unit determining the value of said control signal at said nth clock pulse of said clock signal in the present of said comparative signal indicating one of said first state and said second state to be an intermediate value between the value of said control signal at said (n-1) clock pulse of said clock signal in the presence of said comparative signal indicating the other of said first state and said second state and the latest value of said control signal in the presence of said comparative signal indicating said one of said first state and said second state; and a shifting unit responsive to said control signal so as to change said output signal.

2. The automatic regulating circuit as set forth in claim 1, in which said binary searching unit includes a register having a plurality of stages for storing said control signal, and setting said control signal to an initial value between a maximum value thereof and a minimum value thereof in synchronism with a first clock pulse of said clock signal, said register changing the value of said control signal in synchronism with each of second to said nth clock pulses, a shift register storing a first signal having two bits of a first logic level in synchronism with said first clock pulse, and shifting said two bits from the most significant bit toward the least significant bit in synchronism with each of said second to said nth clock pulses, and a switching circuit having a plurality of stages respectively associated with said plurality of stages of said register, each of said plurality of stages of said switching circuit having first input nodes supplied with said two bits, a second input node supplied with a bit of said control signal from the associated stage of said register, a third input node supplied with said comparative signal and an output node coupled to an input node of said associated stage of said register.

3. The automatic regulating circuit as set forth in claim 2, in which each of said stages of said switching circuit includes a NAND gate having fourth input nodes respectively coupled to one of said first input nodes and said third input node, a first AND gate having a fifth input node coupled to an output node of said NAND gate and a sixth input node coupled to the other of said first input nodes, an inverter having a seventh input node coupled to said other of said first input nodes, a second AND gate having eighth input nodes respectively coupled to an output node of said inverter and said second input node, and an OR gate having ninth input nodes respectively coupled to an output node of said first AND gate and an output node of said second AND gate.

4. The automatic regulating circuit as set forth in claim 2, in which said switching circuit supplies a second signal to said register, and said first signal and said control signal cause said switching circuit to change two bits of said second signal to one of a first bit pattern and a second bit pattern depending upon said comparative signal, said two bits of said second signal being the most significant bit and a first intermediate bit next to said most significant bit at said second clock pulse, said two bits of said second signal being sequentially shifted toward the least significant bit of said second signal by one bit in response to said clock signal.

5. The automatic regulating circuit as set forth in claim 4, in which said two bits takes said first bit pattern in the presence of said comparative signal indicative of said target signal smaller than said reference value and second bit patter in the presence of said comparative signal indicative of said target signal larger than said reference value, said two bits in said first bit pattern being larger in value than said two bits in said second bit pattern.

6. The automatic regulating circuit as set forth in claim 1, in which said binary search unit includes a binary search controlling unit responsive to said comparative signal so as to change the value of a digital control signal in such a manner as to converge toward said target value corresponding to said reference value in synchronism with said clock signal, and a digital-to-analog converter for converting said digital control signal to an analog control signal.

7. The automatic regulating circuit as set forth in claim 6, in which said shifting unit includes a level shifter responsive to said analog control signal so as to produce a level-shifted signal from a potential level of an input signal, a transistor responsive to said level-shifted signal so as to change the amount of current passing therethrough, and a current-to-voltage converting means for converting said current to said output signal.

8. The automatic regulating circuit as set forth in claim 6, in which said shifting unit includes a phase shifter for producing a phase-shifted signal from an input signal, a band-pass filter responsive to said analog control signal for changing a center frequency, and producing a regulated signal, and a multiplier operative to multiply said regulated signal by said phase-shift signal for producing said output signal.

* * * * *